United States Patent [19]

Hancock et al.

[11] Patent Number: 4,940,164

[45] Date of Patent: Jul. 10, 1990

[54] DRINK DISPENSER AND METHOD OF PREPARATION

[75] Inventors: Mark W. Hancock; Marvin M. May, both of Los Angeles, Calif.

[73] Assignee: Aquatec, North Hollywood, Calif.

[21] Appl. No.: 68,017

[22] Filed: Jun. 26, 1987

[51] Int. Cl.[5] ..... B67D 5/08

[52] U.S. Cl. ..... 222/66; 222/640; 222/146.6; 261/DIG. 7

[58] Field of Search ..... 222/52, 56, 59, 61, 222/64, 66–68, 640, 642–643, 129.1, 129.4, 146.1, 146.6, 185, 190, 330; 141/311 R; 261/DIG. 7

[56] References Cited

U.S. PATENT DOCUMENTS

| | | | |
|---|---|---|---|
| 27,274 | 2/1860 | Corbin | 209/138 |
| 27,775 | 4/1860 | Chamberlain | 261/35 X |
| 780,714 | 1/1905 | Ferry | 261/76 |
| 1,115,980 | 11/1914 | Sleeper | 261/113 |
| 1,126,662 | 1/1915 | Stuhler | 261/35 |
| 2,391,320150 | 12/1945 | Bowman | 261/93 |
| 1,872,462 | 8/1932 | Johnson et al. | 261/27 |
| 2,183,561 | 12/1939 | Hamblin | 261/76 |
| 2,560,526 | 7/1951 | Thompson | 261/26 |
| 2,588,677 | 3/1952 | Welty et al. | 261/27 |
| 2,604,310 | 7/1952 | Brown | 261/35 |
| 2,674,263 | 4/1954 | Rupp et al. | 137/604 |
| 2,708,533 | 5/1955 | Nicholas | 222/146 |
| 2,735,370 | 2/1956 | Lance | 103/118 |
| 2,735,665 | 2/1956 | Lance | 261/27 |
| 2,750,076 | 6/1956 | Welty et al. | 222/129.1 |
| 2,798,135 | 7/1957 | Graham | 200/152 |
| 2,823,833 | 2/1958 | Bauerlein | 222/129.2 |
| 2,894,377 | 7/1959 | Shikles, Jr. et al. | 62/306 |
| 2,988,343 | 6/1961 | Edwards et al. | 261/25 |
| 3,199,738 | 8/1965 | Cary et al. | 222/129.2 |
| 3,225,965 | 12/1965 | Jacobs et al. | 222/129.1 |
| 3,292,822 | 12/1966 | Crowder et al. | 222/129.1 |
| 3,382,897 | 5/1968 | Skiera et al. | 141/107 |
| 3,397,870 | 8/1968 | McCann et al. | 261/19 |
| 3,408,053 | 10/1968 | Vantroba | 261/27 |
| 3,495,803 | 2/1970 | Schoepe et al. | 251/25 |
| 3,618,905 | 11/1971 | Primue | 261/153 |
| 3,688,950 | 9/1972 | Parish | 222/146.1 |
| 3,726,102 | 4/1973 | Parks | 62/70 |
| 3,756,473 | 9/1973 | Donahue, Jr. | 222/129.2 |
| 3,756,576 | 9/1973 | Tremolada | 261/35 |
| 3,761,066 | 9/1973 | Wheeler | 261/78 |
| 3,809,292 | 5/1974 | Branch et al. | 222/146 |
| 3,926,102 | 12/1975 | De Lepeieire | 98/102 |
| 3,926,342 | 12/1975 | Barden et al. | 222/129.1 |
| 4,068,010 | 1/1978 | Karr | 426/477 |
| 4,093,681 | 6/1978 | Castillo et al. | 261/122 |
| 4,108,167 | 8/1978 | Hickman et al. | 128/66 |
| 4,148,334 | 4/1979 | Richards | 137/389 |
| 4,173,178 | 11/1979 | Wieland | 99/323.1 |
| 4,205,599 | 6/1980 | Franzosi | 99/323.1 |
| 4,216,885 | 8/1980 | Sedam | 222/481 |
| 4,222,825 | 9/1980 | Eisden | 203/11 |
| 4,225,537 | 9/1980 | Martonffy | 261/70 |
| 4,229,634 | 10/1980 | Hickman et al. | 200/302 |
| 4,242,061 | 12/1980 | Hartley | 417/536 |
| 4,302,186 | 11/1981 | Cammack et al. | 433/80 |
| 4,304,736 | 12/1981 | McMillin et al. | 261/35 |
| 4,316,409 | 2/1982 | Adams et al. | 99/275 |
| 4,359,432 | 11/1982 | Sedam et al. | 261/26 |
| 4,401,607 | 8/1983 | Child et al. | 261/121 |
| 4,422,371 | 12/1983 | Child et al. | 99/323.1 |
| 4,440,318 | 4/1984 | Berger | 222/129.1 |
| 4,466,342 | 8/1984 | Basile et al. | 99/323.1 |
| 4,475,448 | 10/1984 | Shoaf et al. | 99/323.1 |
| 4,509,569 | 4/1985 | Adolfsson | 141/360 |
| 4,518,541 | 5/1985 | Harris | 261/27 |
| 4,564,483 | 1/1986 | Jeans | 261/64 |
| 4,597,509 | 7/1986 | Pereira | 222/129 |
| 4,632,275 | 12/1986 | Parks | 222/25 |
| 4,635,824 | 1/1987 | Gaunt et al. | 222/129.1 |
| 4,655,124 | 4/1987 | Child | 99/323.2 |
| 4,659,520 | 4/1987 | Tarver | 261/25 |
| 4,660,741 | 4/1987 | Kirschner et al. | 222/1 |
| 4,703,870 | 11/1987 | Sedam | 222/66 |
| 4,729,495 | 3/1988 | Aschberger et al. | 222/56 |
| 4,742,939 | 5/1988 | Galockin | 222/68 |

*Primary Examiner*—Michael S. Huppert
*Attorney, Agent, or Firm*—A. C. Smith

[57] ABSTRACT

The improved method and apparatus for dispensing carbonated water from a supply of cooled water includes thermal coaction of carbonator apparatus with a reservoir of cooled water, and includes a control system to inhibit water-pumping operation into the carbonator apparatus after the reservoir of cooled water is depleted.

16 Claims, 18 Drawing Sheets

DRINK DISPENSER AND METHOD OF PREPARATION

RELATED CASES

The subject matter of this application is related to the subject matter in application Ser. No. 068,018, now Pat. No. 4,850,269, entitled "Low Pressure, High Efficiency Carbonator and Method", filed on June 26, 1987 by Mark W. Hancock and Marvin M. May, and in application Ser. No. 067,803, now Pat. No. 4,859,376, entitled "Gas-Driven Carbonator and Method", filed on June 26, 1987 by Mark W. Hancock and Marvin M. May, which are incorporated herein by reference.

FIELD OF INVENTION

This invention relates to carbonated water dispensers of the type which use bottled water (or water from a non-pressurized source) as the inlet water source, and particularly to dispensers of carbonated water for office or home applications.

BACKGROUND OF THE INVENTION

A carbonator known in the art is configured to be retrofitted to existing bottled-water dispensers to compliment the normal cold water dispensing operation thereof with the dispensing of carbonated water. (see, for example, Pereira U.S. Pat. No. 4,597,509). One disadvantage encountered with carbonators of this type is that such configurations are not conducive to low-cost manufacture of a dedicated dispenser. In addition, a carbonator of such configuration operates with the limitations of the primary or host apparatus.

Another deficiency in carbonators of this type is the lack of an adequate control system to disable the carbonating pump when no carbonating water is present. Further, the type of pump used cannot run dry without being damaged and without overheating. Since consumers often do not change water containers until the receiving reservoir is completely dry, pump protection is important.

Most drinking water coolers hold and dispense cooled water at about 40–50° F. Dispensing carbonated water at the higher end of this range results in rapid decarbonation that is detectable by the consumer. If such carbonated water is further diluted with flavoring syrup, the resulting drink is 'flat' by most standards. Since most drinking water dispensers are not engineered to build significant amounts of ice, only a limited number of carbonated drinks of high quality can be drawn from such a modified dispenser.

In the home environment, carbonators may be configured to stand alone, for example, as countertop units which must be refilled from available tap water or, alternately from pressurized water mains. Units of this type must be protected from operating unnecessarily with concomitant reduced lifetime and against damaging operation associated with depletion of a refillable water reservoir. Also, such water reservoir should be conveniently removable for periodic cleaning and refilling to avoid the growth and accumulation of mold and fungus. Another difficulty encountered with carbonators for home applications is the waiting time associated with carbonating the water to make a soft drink. Further, the current market demands more convenience and quicker availability of a finished soft-drink than is commonly possible with known carbonators (See, for example, Child et al, U.S. Pat. No. 4,401,607, Child et al, U.S. Pat. No. 4,422,371, Adolfsson, U.S. Pat. No. 4,509,569, and Jeans U.S. Pat. No. 4,564,483). Systems of these types, although simple and of low cost, are generally of the batch-type, require a number of manual operations and are unable to produce substantially on-line supplies of carbonated water. Also, although high-quality and convenience syrup post-mixing systems are available for home use, such systems are costly and beyond the means of most consumers. Since these systems are commonly downscaled commercial systems, their size and complexity of operation require a degree of learning and skill most consumers will not tolerate.

Concerns by a growing number of consumers about contaminants in potable water supplies have created much interest in bottled and purified water for beverages. As a result, beverage systems which can use only municipal sources may have a perceived disadvantage for consumers who do not have water purification equipment already installed. Systems which use municipal water as the supply source are usually adaptations of commercial post-mix systems of which examples are cited above.

Carbonated beverage dispensing systems have also been described for home use by incorporating the system into the home refrigerator (See, for example, Sedam et al U.S. Pat. No. 4,306,667 and Re 32, 179, and Shikles, Jr. et al U.S. Pat. No. 2,894,377). Systems of these types have been directed toward the storage and dispensing of flavoring syrups concurrently with the dispensing of carbonated water. The equipment and complexity added by the syrup-mixing equipment typically increase the costs beyond reach of most consumers.

Another difficulty encountered with prior-art systems of the type described above is that they are not well adapted for use in small offices or in the home. In one such soft drink system as described by Gaunt et al U.S. Pat. No. 4,635,824, the system appears to minimize the costs and amount of syrup-mixing equipment required, but appears to be directed primarily at brix control (sugar content and flavor strength) and less at the carbonator and the other elements of the system. While some attention is given the accuracy of post-mix flavor mixing systems in the prior art, it appears that consumer tastes vary with respect to the preferred soft-drink flavor strength. Some of the prior-art systems provide for varying flavoring strength in post mix systems (See, for example, Donahue U.S. Pat. No. 3,756,473), but such systems commonly include associated storage and dispensing equipment which increase size and cost. In the past, carbonated soft drinks were made by placing a small amount of flavoring concentrate in the bottom of a beverage glass, adding carbonated water, and stirring with a spoon. While this procedure worked well in commercial soda fountain environments, it is not well suited to use in the home or office where use of a spoon is inconvenient. It does, however provide a means for easily varying the strength of the beverage to individual taste.

Other beverage dispensing apparatus are also disclosed in the literature (See, for example, U.S. Pat. Nos. 2,823,833; 3,292,822; 2,735,665, 2,588,677, 3,225,965, 3,726,102, 4,304,736, 2,894,377, Re. 32,179, 4,440,318, 4,093,681, 4,225,537, 4,635,824, 4,632,275, 4,655, 124, 4,597,509, 4,564,483, 4,518,541, 4,509,569, 4,475,448, 4,466,342, 4,422,371, 4,401,607, 4,316,409, 4,242,061, 4,222,825, 4,205,599, 4,173,178, 4,068,010, 3,761,066, 3,756,576, 3,756,473, 3,926,102, 3,495,803, 3,408,053, 3,397,870, 3,292,822, 3,225,965, 2,823,833, 2,798,135, 2,735,370, 2,560,526, 1.872,462, 1,115,980, 780,714.

SUMMARY OF THE INVENTION

Accordingly, it is an object of the present invention to provide a dispenser of drinking water and carbonated water with increased carbonated water capacity and quality. It is another object to provide a high-quality, soft drink dispensing system that is integral with such a unit. It is still another object of the invention to provide a pump control system to disable the carbonator pump under selected operating conditions. It is yet a further object of the invention to provide an integrated dispenser which is inexpensive to manufacture. It is also an object of the present invention to provide an inexpensive beverage dispenser system suitable for use in the home or office which is capable of operating substantially on-line and without waiting. It is still another object of the present invention to provide a carbonated beverage dispenser which is able to make carbonated beverages from municipal tap water or water supplied from a refillable reservoir. It is another object of the present invention to provide a low cost means of making a soft drink which obviates the need for a substantial amount of equipment and controls normally associated with post-mix beverage systems.

These and other objects are achieved in accordance with the present invention which includes a carbonator that, in one embodiment, is supplied with chilled water from a reservoir which is replenished by a bottled-water supply as uncarbonated and carbonated water is withdrawn. An inexpensive carbonator is disposed in or near the reservoir of chilled water for isothermal formation and storage of carbonated water available for dispensing on demand. Control circuitry is included to disable the carbonator Pump under adverse operating conditions.

In another embodiment of the present invention that is particularly suitable for home or small office applications, the carbonator is supplied with water from a detachable reservoir. Control circuitry regulates the operation of the water pump to assure safe carbonator operation and freedom from damage attributable to depletion of the water supply. In all such embodiments, post-mix schemes for combining carbonated water with selected flavored syrups obviates the need for complicated syrup flow control equipment, measuring vessels or mixing spoons.

DESCRIPTION OF THE PREFERRED EMBODIMENT

Figure 1:
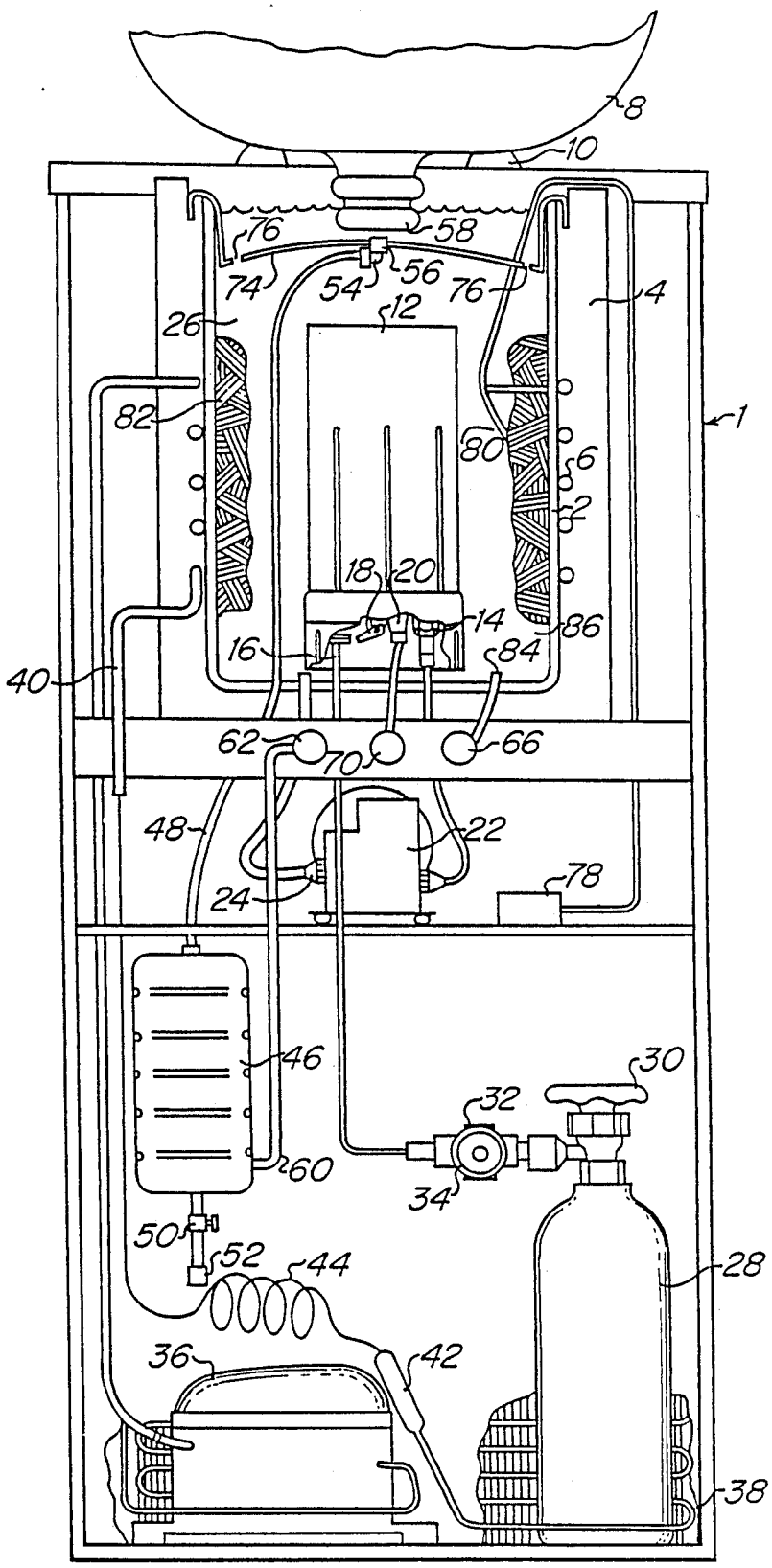
FIG. 1 is a schematic representation of a cutaway, sectional view of the carbonated (and uncarbonated) water dispenser according to one embodiment of the present invention.

Referring now to FIG. 1, there is shown a cutaway sectional view of the present invention showing the component parts. The dispenser is generally designated as 1 and includes a fluid reservoir 2 surrounded by insulating material 4 and cooling coils 6. An inverted bottle or container 8 is held in place by annular support 10 above the reservoir 2. The carbonator 12 is disposed in or near the fluid reservoir 2 in substantially isothermal relationship with the chilled water 26. One suitable carbonator is illustrated and described in the aforecited co-pending application Ser. No. 068,018 and includes a pressurized water inlet connection 14, a carbon dioxide inlet 16, a safety valve 18 and carbonated water outlet 20. Pressurized water is supplied to inlet connection 14 by pump 22 whose inlet 24 is connected to receive water 26 from the reservoir 2.

Figure 8:
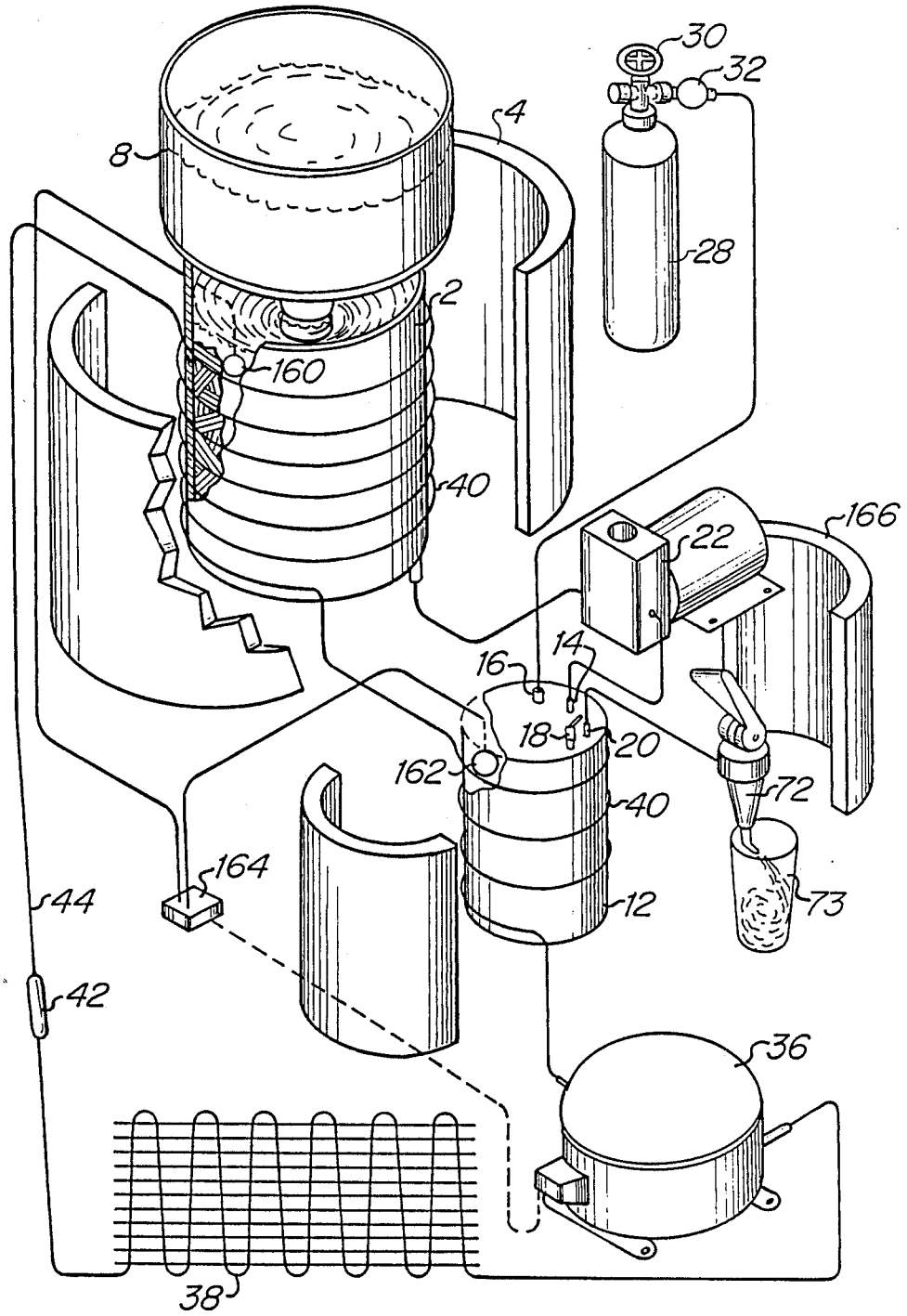
FIG. 8 is an exploded view of the apparatus according to one embodiment of the present invention.

Carbon dioxide inlet 16 is supplied with carbon dioxide gas from storage cylinder 28 via isolation valve 30 and regulator 32. The system may also include a pressure gauge to indicate either pre-or post-regulator pressure. A conventional refrigeration system including a compressor 36, a condensing coil 38 and an evaporator coil 40 is disposed to chill the water 26 and the carbonator in reservoir 2. Alternatively, the carbonator 12 may also be chilled directly by evaporator coil 40 shaped in close proximity around the carbonator 12 as depicted in FIG. 8. The evaporator is supplied from the condenser by means of filter-drier 42 and capillary 44.

Figure 2:
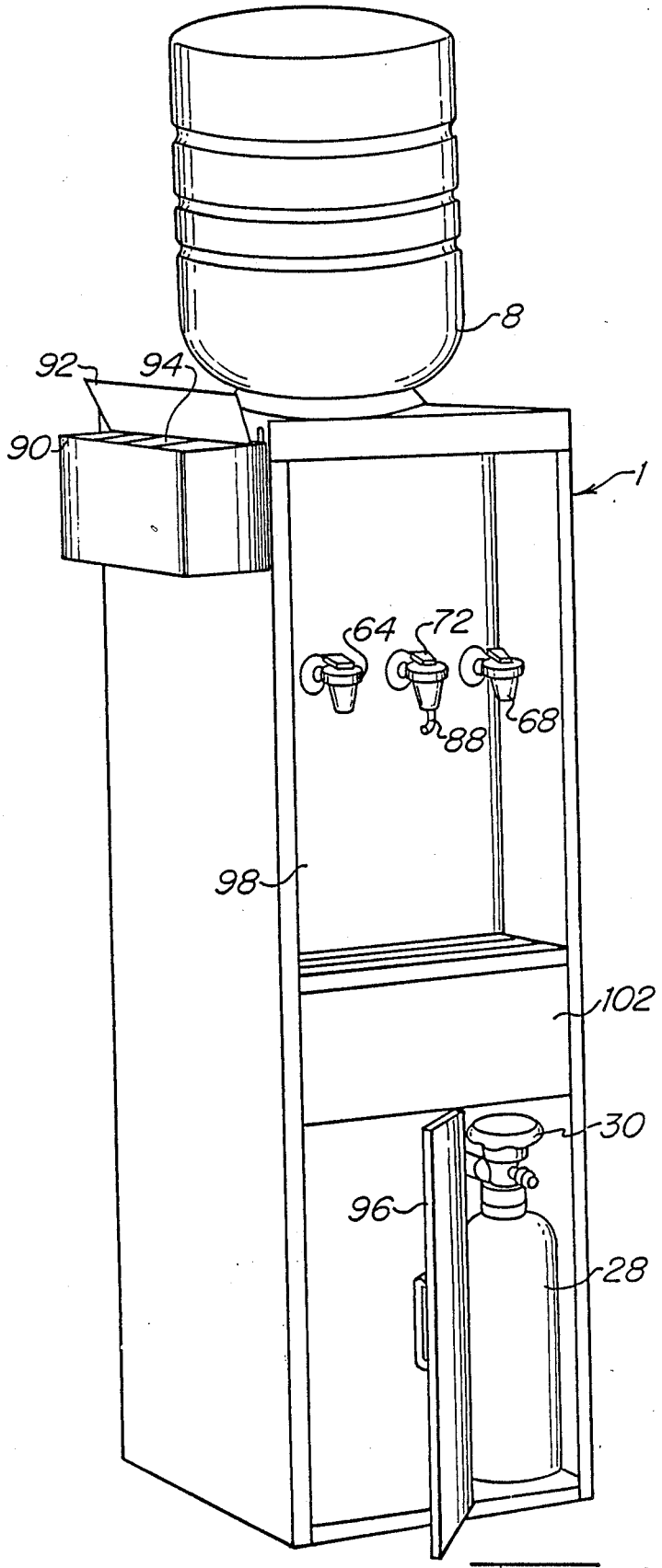
FIG. 2 is a perspective view of the water dispenser of FIG. 1.

The dispenser is also provided with a water heater 46 for heating water supplied from reservoir 2 via the water heater inlet conduit 48. Water heater 46 is provided with a drain valve 50 and outlet 52 for periodic maintenance thereof. Water heater inlet conduit 48 is connected to a fitting 54 having an inlet 56 disposed near the mount 58 of the bottle or container 8 above the region of chilled water in reservoir 2. The outlet 60 of water heater 46 is connected to hot-water port 62 and subsequently to hot-water dispensing valve 64, as shown in FIG. 2. The dispenser 1 is also provided with a cold-water port 66 that is connected to the reservoir 2 and to the cold-water dispensing valve 68, as shown in FIG. 2. In a similar fashion, the carbonated water port 70 is connected to the outlet 20 of carbonator 12 and to the carbonated water dispensing valve 72, as shown in FIG. 2.

To start up the dispenser, the bottle or container of water 8 is inverted to rest on annular support 10. Water then fills the space above baffle 74 and drips through perforations 76. This process continues until the entire reservoir 2 is filled with water 26. The refrigeration system, under the control of a conventional thermostat or ice bank controller 78 and sensor 80, builds ice 82 in reservoir 2 as heat is transferred out of the water 26 in the reservoir 2. When the ice has reached a predetermined thickness as sensed by sensor 80, compressor 36 is disabled. The system is allowed to stand without further cooling until ice 82 has melted to a predetermined minimum thickness after which compressor 36 is enabled to again build ice. Of course, compressor 36 may also be controlled by conventional techniques known in the art.

The water 26 in the reservoir 2 is cooled by the ice 82 and can be dispensed on demand through cold water dispensing valve 68. The inlet 84 may be placed at a level within reservoir 2 to deliver the cold water at a desired temperature. It is desirable that the water drawn off for the water heater 46 not be cooled first. For this purpose, inlet 56 is provided proximate the mouth 58 of container 8 and above the level of chilled water in reservoir 2.

When the water level in carbonator 12 falls below a predetermined minimum level as determined by a suitable level sensor (not shown), pump 22 is activated to fill the carbonator with cooled water 86 from the reservoir 2. As cooled water 86 is withdrawn from the reservoir 2, either via carbonator 12 or via hot- or cold-water dispensing valves 64, 68, the liquid level therein falls below the level of mouth 58 of the bottle 8. Air then enters the bottle 8 to displace similar volumes of water. The replacement water enters the upper portion of reservoir 2 and flows through the perforations 76 of baffle 74. The water streaming through the perforations 76 is directed against the layer of ice 82 that forms on the inner surface of the reservoir 2 to assure quick cooling upon contact with ice 82. The rate of flow of water 26 through perforations 76 into the main body of water 26 is controlled to promote rapid cooling of inlet water against ice 82. The shape and location of ice formation may of course be varied. For example, evaporator coil 40 may be compacted and disposed above the level of the carbonator 12 to form a toroid like ice bank between perforations 76 and carbonator 12.

The carbonator 12 may, in one embodiment, include a pressure vessel for carbonating a quantity of water therein with carbon dioxide gas that is supplied thereto under pressure. Carbonators of this type are described in the aforementioned pending application by the same inventors, and the pressure vessel thereof may be disposed within the reservoir 2 in contact with the chilled water for improved low-temperature, isothermal carbonator operation and storage. Alternatively, the carbonator 12 may be substantially isothermally coupled to the chilled water 26 but isolated therefrom by being disposed outside the reservoir 2 with the evaporator coils 40 positioned in close proximity about the reservoir 2 and carbonator 12, as illustrated in FIG. 8.

FIG. 2 shows an exterior view of a preferred embodiment of the present invention. The carbonated water dispensing valve 72 is provided with an extended angular Portion 88 which may be selectively positioned near the bottom of a cup or other container, or alternatively may be positioned near the top of the container or beverage glass to cause a swirling, mixing action along the walls and generally within the container as carbonated water is dispensed into such container.

Figure 17:
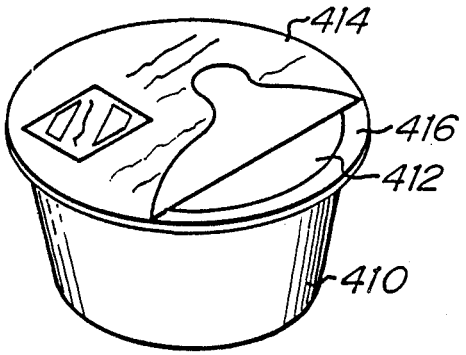
FIG. 17 is a perspective view of an individual serving container of flavoring material for a soft drink.

The dispenser 1 is also equipped with a soda syrup storage container 90 having a cover 92 for holding a supply of single-serving syrup cups or packets, as illustrated in FIG. 17, from which a soft drink can be made. In a preferred embodiment, the soda-syrup storage container 90 includes a number of compartments 94 that hold a number of different soft-drink concentrated flavors.

Figure 16:
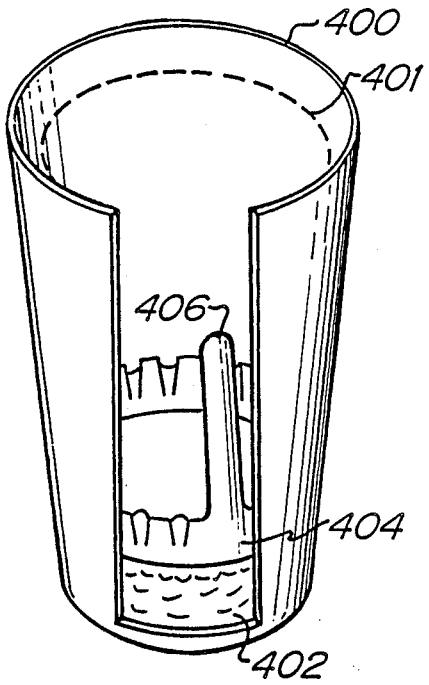
FIG. 16 is a sectional view of a beverage container having a precharged volume of flavoring material sealed therein for post-mix preparation of a soft drink.

In use, a consumer selects one of the syrup packages from the storage container, opens it, and pours the contents into a cup or other suitable container. The flavor concentrate is thoroughly mixed within the cup or container by the swirling action produced by the angular portion 88 of the dispensing valve 72 as carbonated water is dispensed therethrough into the cup or container. Individual packages of flavor concentrates are appropriately suited for use in the office (and home) environment because a measuring spoon or vessel and stirrer are eliminated. Preferred forms of such individual packaging are illustrated in FIGS. 16 and 17 and include plastic or protected foil cups covered with removable plastic or protected foil seal, plastic packets, and the like, where foil and other materials must be compatible with low pH of such flavor concentrates.

The dispenser 1 includes an access door 96 to facilitate simple changes of the carbon-dioxide supply cylinder 28. A 2½ pound storage cylinder 28 of carbon dioxide is normally adequate to make about five hundred 6-oz. soft drinks. An overflow and drain container 100 is positioned 2.

Figure 3:
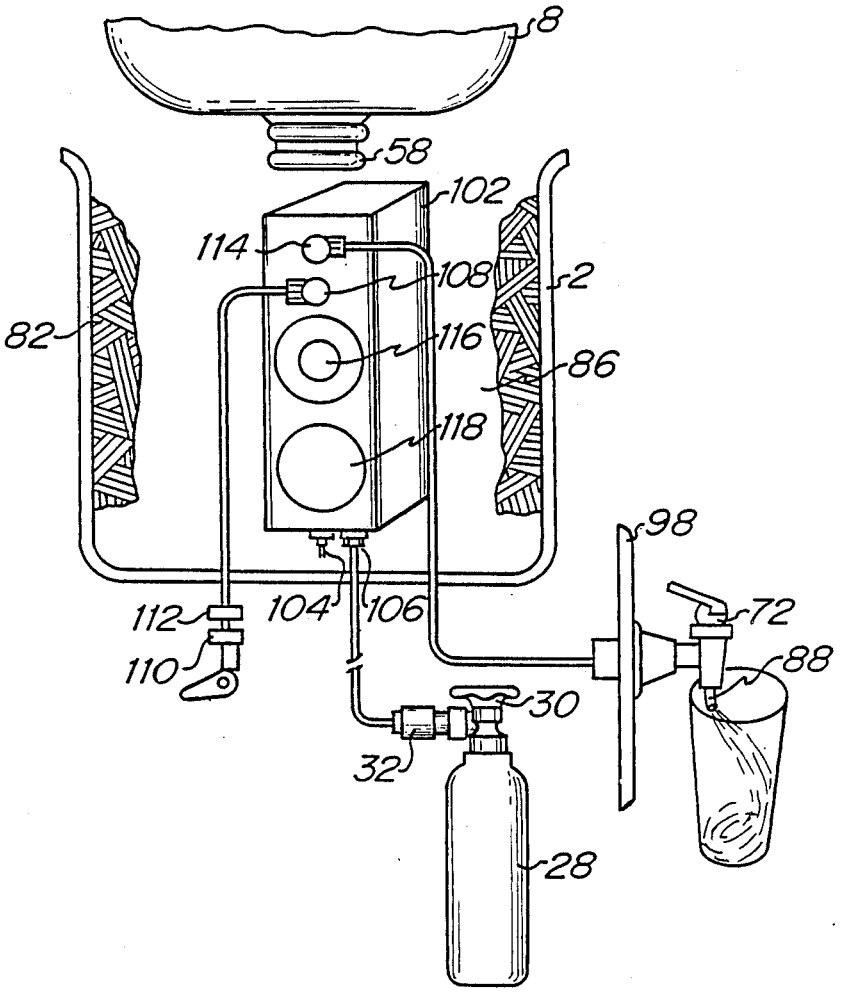
FIG. 3 is a partial cutaway sectional view of another embodiment of the present invention employing a gas-driven, in-line carbonator.

Referring now to FIG. 3, there is shown a partial sectional view of an alternate embodiment of the present invention using an in-line carbonator, for example, of the type described in the aforecited co-pending patent application Ser. No. 067,803. Such carbonator 102 includes a gas-driven water pump that is supplied with cooled water 86 at inlet 104 and that is also supplied with gas at inlet 106 for pressurizing the cooled water and for carbonating the cooled water as it flows through the carbonator. The carbonator 102 has a carbon dioxide vent port 108 connected to safety and vent valve 110 which has an adjusting nut 112 for controlling the relief pressure thereof. The outlet port 114 for carbonated water is connected to the dispensing valve 72.

In operation, the chilled water available within the reservoir 2 is pumped through the carbonator 102 by a pump which is actuated by the carbon dioxide gas. The exhaust carbon dioxide gas from the pump then carbonates the water flowing through from inlet 104 to outlet 114, on demand, as controlled by manual dispensing valve 72.

Figure 4:
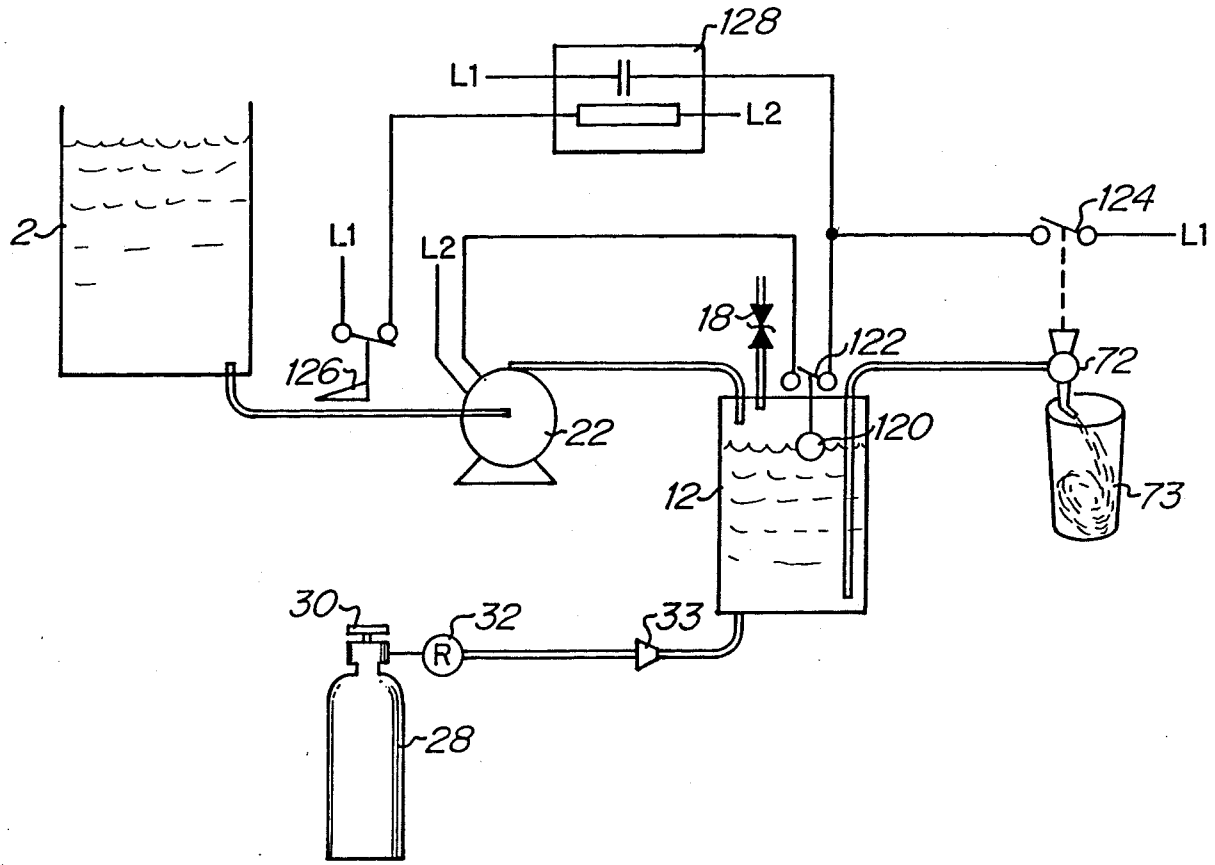
FIG. 4 is a schematic diagram of the control circuitry for operating the dispenser of the present invention.
Figure 7:
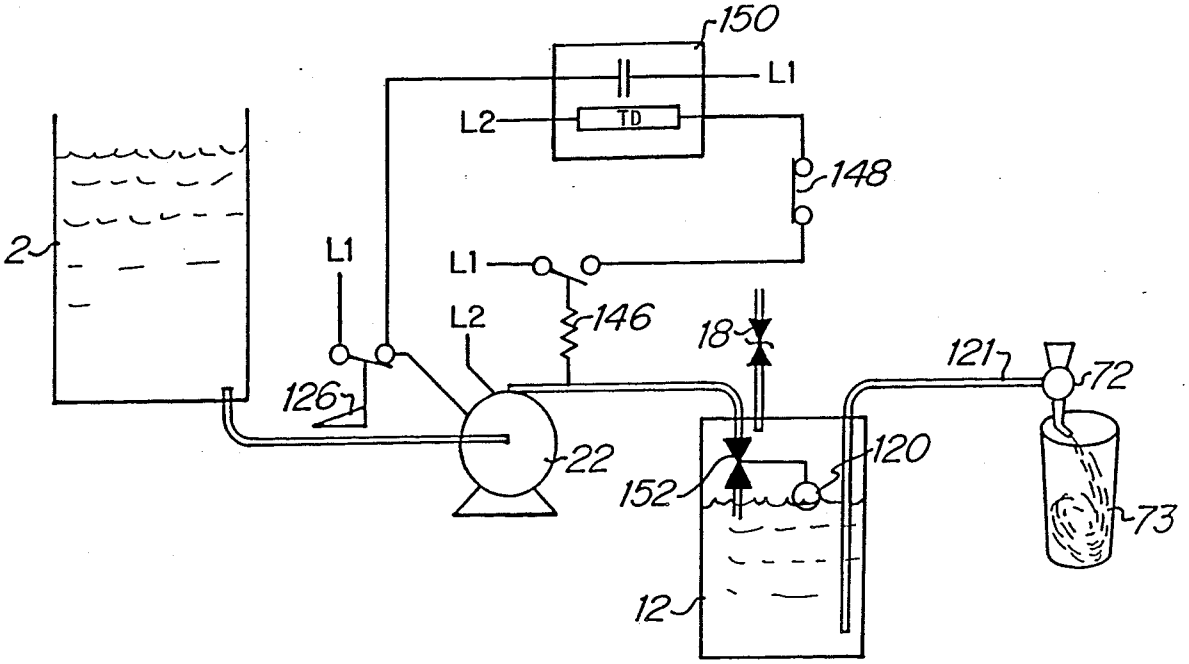
FIG. 7 is an alternative embodiment of control circuitry for the present invention.

Referring now to FIG. 4, there is shown a schematic diagram of the control circuitry for the dispenser of the present invention. Switch 124 may be included in the dispensing valve 72 to be activated by a pressure switch or flow switch in the outlet line 121. Dispensing provides contact closure which provides current to level-responsive switch 122. Switch 122 may be a pressure switch on the outlet of the pressurizing pump coupled with a level sensitive valve as shown in FIG. 7. Alternatively switch 122 may be a float switch in the tank 12, or other means providing a contact closure on the fall of liquid in the carbonator tank 12. In addition, a flow-detector switch 126 provides a contact closure on fluid flow from the reservoir to the pump 22 Since many flow switches use low current magnetic proximity switches, a relay 128 is included to provide switch contacts of the proper current rating. Direct connection to the flow switch is of course possible if the contact rating is sufficient. Flow detector 126 may be located either before or after the pump 22 and generically can be considered to be responsive to the presence of water being pumped. Flow detector 126 could also be a vacuum switch disposed between the pump and reservoir. In this way, the control system may also be considered to include current sensing or other means operatively connected to pump 22 for disabling the pump in response to depletion of the water in reservoir 2.

In operation, the pump 22 is self priming and can start pumping water as available from reservoir 2. For some types of pumps, it is desirable to include liquid inlet means sufficiently large in diameter so that when reservoir 2 is filled, fluid to be carbonated is immediately available to the pump inlet. Further, the priming of some types of pumps may be assisted by the relief of gas pressure in the carbonator when the dispensing valve is opened. Thus, the reservoir 2 is initially filled with water and the carbon-dioxide isolation valve 30 is opened. Then, the dispensing valve 72 is manually held open until the pump primes and pumps water into the carbonator tank 12. At this point, flow detector 126 activates relay 128 and the pump 22 continues to run until the upper-level limit determined by switch 122 is reached in the carbonator tank 12. The pump 22 and the flow from reservoir 2 then stops and the contacts of flow detector 126 and relay 128 open. Normal operation proceeds each time the dispensing valve is opened and the switch 124 is closed.

Consider normal operations as the supply of water in reservoir 2 is depleted. If dispensing is occurring, the contacts of flow detector 126 are closed and the reservoir 2 runs out of water. The contacts of flow detector 126 open (no flow) and dispensing will continue until the carbonator 12 is empty. During dispensing, the pump 22 will run and try to pump without inlet water. The pump 22 therefore must be capable of self priming (in this application) and running for short periods without inlet water.

Figure 5:
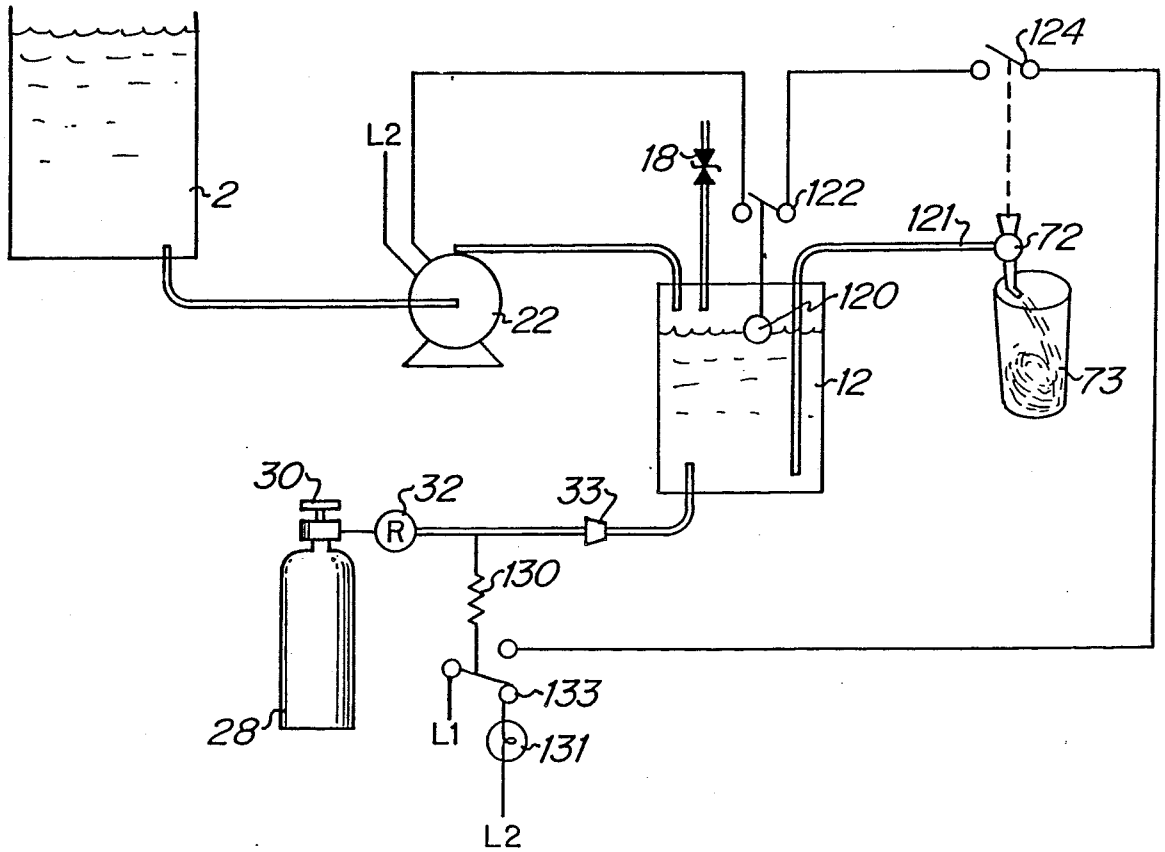
FIG. 5 is a schematic diagram of control circuitry including a sensor for the pressurized gas supply.

In another embodiment of the Present invention, as illustrated in FIG. 5, the dispensing switch 24 and the level switch 122 are in series with the gas pressure switch 133. The pump must be able to keep up with the dispensing rate. The series switch connection with the $CO_2$ pressure switch is so that dispensing responsive switch 126 may be a pressure switch connected in outlet line 121. Thus, when $CO_2$ runs out, there will be no false dispensing signal to the pump control system. Thus, when the pressure delivered through regulator 32 falls below a predetermined minimum level, the switch 133 associated with pressure sensor 130 changes position and lights indicator lamp 131. The electrical supply to dispensing switch contacts 124 is simultaneously removed. Thus, when the carbon dioxide supply is exhausted, the pump 22 is disabled and the operation of this illustrated embodiment of the carbonator is similar to the operation of the embodiment illustrated and described in connection with FIG. 4. In the embodiment of FIG. 5, a larger pump is required to keep up with the dispense rate, but less expensive controls may be used.

Figure 6:
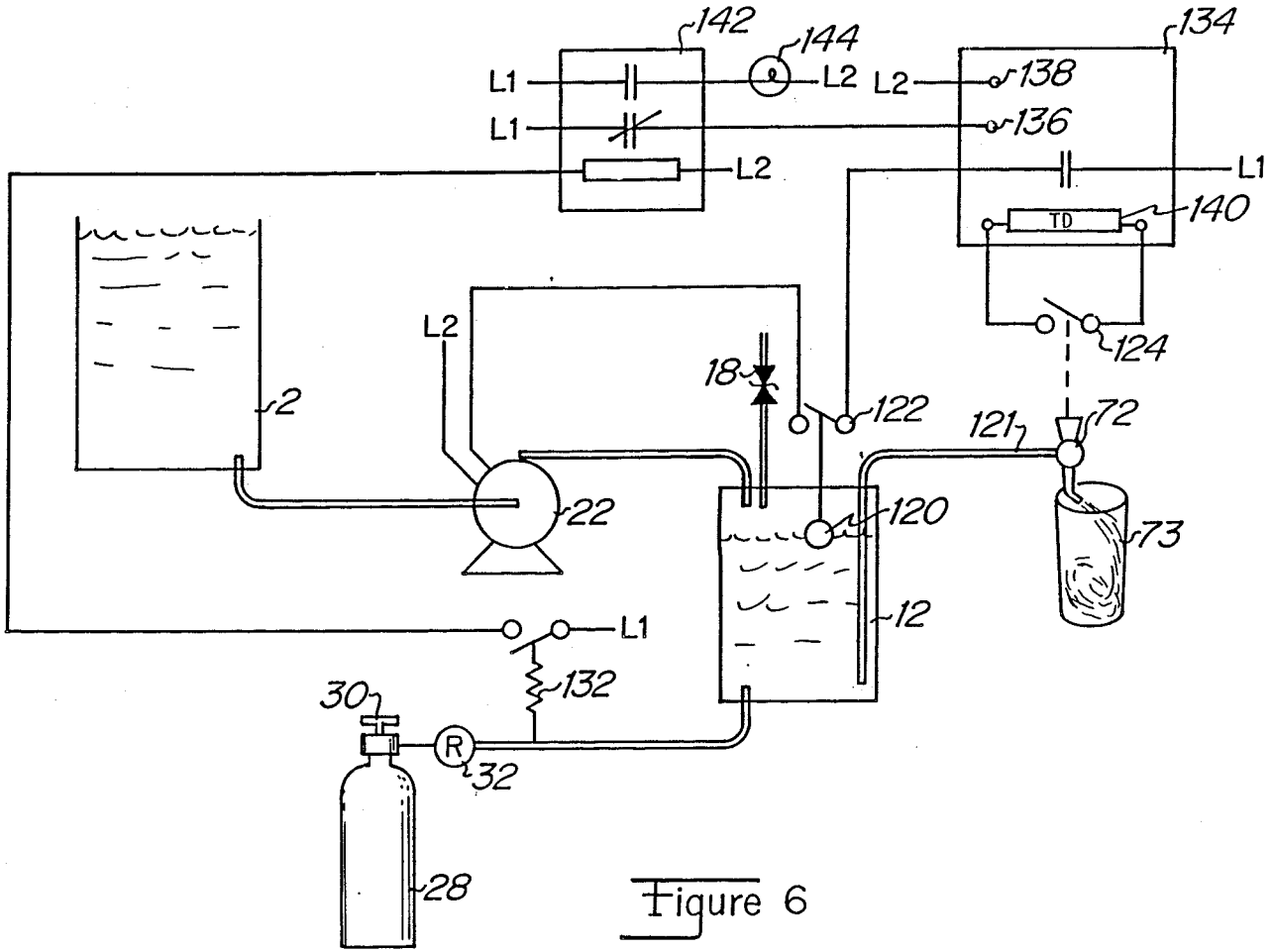
FIG. 6 is a schematic diagram of another embodiment of the control circuitry for the present invention.

Referring now to FIG. 6, there is shown an alternate embodiment of control circuitry for the carbonator of the present invention. Specifically, this embodiment includes a low carbon-dioxide indicator-lamp 144 to alert the consumer that the carbon dioxide needs to be recharged or the cylinder replaced. The pressure switch 132 (which closes when pressure drops) operates relay 142 to remove power from time-delay relay 134. This in turn inhibits power from reaching contacts 122 and pump 22. Alternatively, if the indicator lamp 144 is not desired, relay 142 may be eliminated by replacing pressure switch 132 with a pressure switch which opens on pressure drop. The delay on release-time delay relay 134 of conventional design permits the use of a much smaller and less expensive pump 22 because the pump is then not required to keep up with the dispense rate. In this embodiment, the time-delay relay controls pump operation for an interval after dispensing is completed. The dispensing switch 124 is serially connected between the line connections 136, 138 and the time-delay relay coil 140.

Alternatively, a current sensor on the electrical supply to the pump 22 may detect when inlet water is no longer Passing through the pump. Such current sensor may be used in place of a flow switch since a motor driving the pump draws higher current while pumping than when not pumping due to absence of liquid to be pumped.

Referring now to FIG. 7, there is shown another embodiment of the control circuitry according to the present invention. The level sensor 120 drops as carbonated water is withdrawn from the carbonator tank 12 until a lower limit is reached which fully opens valve 152 to allow water to enter carbonator tank 12. The pressure switch 146 in the water supply line to valve 152 closes and supplies power to pump 22 via closed contact of time-delay relay 150. Time delay relay 150 is of the conventional type which closes for a predetermined period of time upon application of power and resets when input power is removed. As water flows through pump 22, the flow switch 126 in the water line to the pump 22 (or vacuum switch or current sensor set to close when liquid is being pumped) closes and continues to supply power to pump 22 even after the time interval of time-delay relay 150 has elapsed. In practice, the delay of time-delay relay 150 is about 10 seconds, which time is sufficient for pump 22 to prime.

When the upper fluid level is reached in carbonator 12, valve 152 closes and the increased pressure in the supply line to valve 152 causes pressure switch 146 to open shortly thereafter. This causes the flow to stop which also causes the flow switch 126 to open In the situation where the carbonator is filling and the water being supplied to the carbonated runs out, flow switch 126 opens and causes the pump to stop if time-delay relay 150 has not timed out. If time-delay relay 150 has not timed out, the pump 22 will continue to operate until it does.

When the inlet water has run out and time delay relay 150 has timed out, pump 22 will remain disabled even though water reservoir 2 is refilled. A normally closed momentary contact reset switch 148 is interposed between pressure switch 146 and relay 150 to supply the necessary contact break to reset relay 150. Manual operation of the push button switch 148 resets the system and allows a predetermined time (about 10 seconds) for the pump 22 to prime.

It should be noted that in each of the embodiments of FIGS. 4 and 7, it is possible to replace the flow switch with a vacuum (or absolute pressure or motor current-sensing) switch in the same location. Such a switch would be closed as long as a vacuum at the pump inlet is detected and it would open when the vacuum is broken by air in the line. Such a switch could be placed sufficiently upstream from the pump inlet that the pump would not lose its prime on water remaining in the supply line before loss of vacuum is detected and the pump is shut off.

Control systems as in FIGS. 4, 5, 6 and 7 as particularly useful in reservoir carbonation systems such as described in FIG. 1 where ice or other space limitations make liquid level sensing means impractical. Likewise, such controls are useful in systems of the type described in FIG. 10 where the water reservoir is removable.

Referring now to FIG. 8, there is shown an exploded perspective view of the apparatus of FIG. 1, including sensor 160 disposed to detecting temperature or ice thickness in the region of reservoir 2 and including sensor 162 disposed to detect temperature near or within the carbonator vessel 12. These sensors are connected to one or more controllers 164 that operate the refrigeration compressor 36. In this particular example, a single evaporator coil is controlled by the two sensors 160 and 162 to create near freezing temperatures in the carbonator while creating near freezing temperatures or building ice in reservoir 2. A benefit of building ice is that the drink making capability of the dispenser is increased and more stable carbonation control results. Additional temperature/ice bank control of the single evaporator system may be effected by varying the number of coils wrapped around the carbonator 12 and reservoir 2 which means may be used to simplify the temperature/ice sensors and controls necessary to operate the compressor 36. Alternatively, two separate evaporator coils can be employed with a temperature-/ice bank sensor associated with each system. The flow of refrigerant fluid can be regulated between one evaporator coil and the other by installing conventional valves to control the flow of refrigerant from the carbonator coil to the reservoir coil. The reservoir 2 and carbonator 12 each have insulating jackets 4, 166 surrounding them to minimize heat transfer from the environment.

Figure 9:
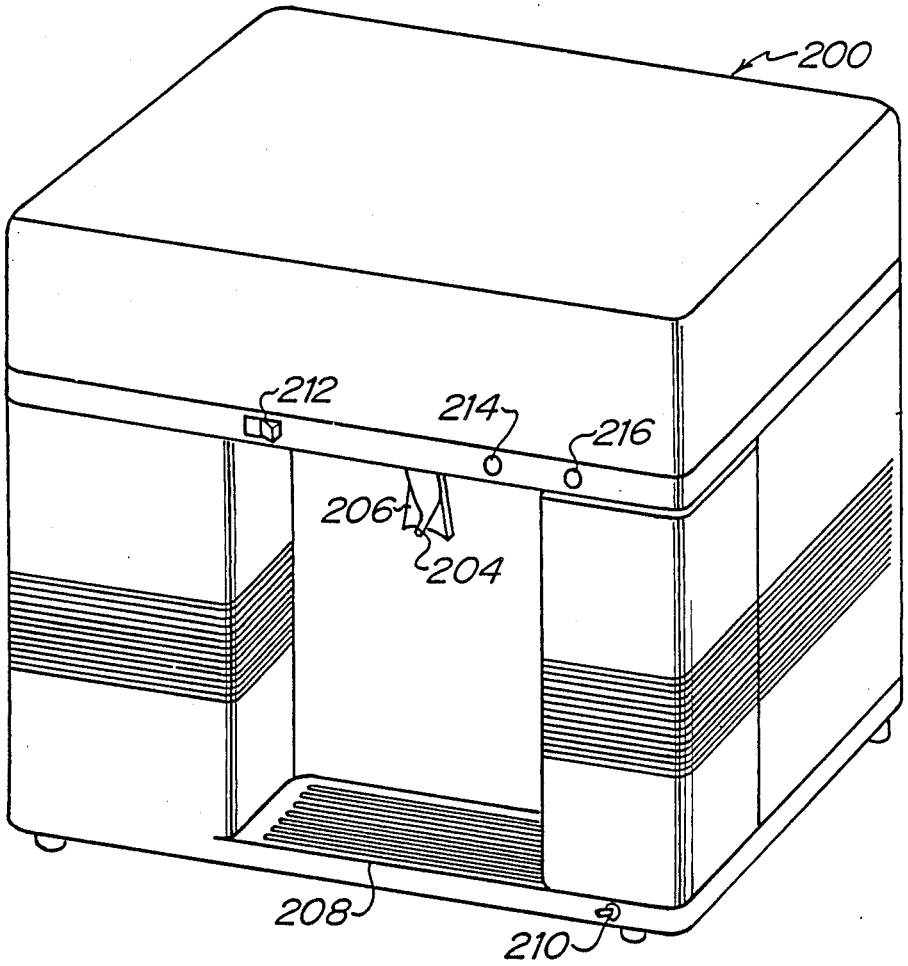
FIG. 9 is a perspective view of a standalone dispenser unit suitable for home dispenser applications.
Figure 10:
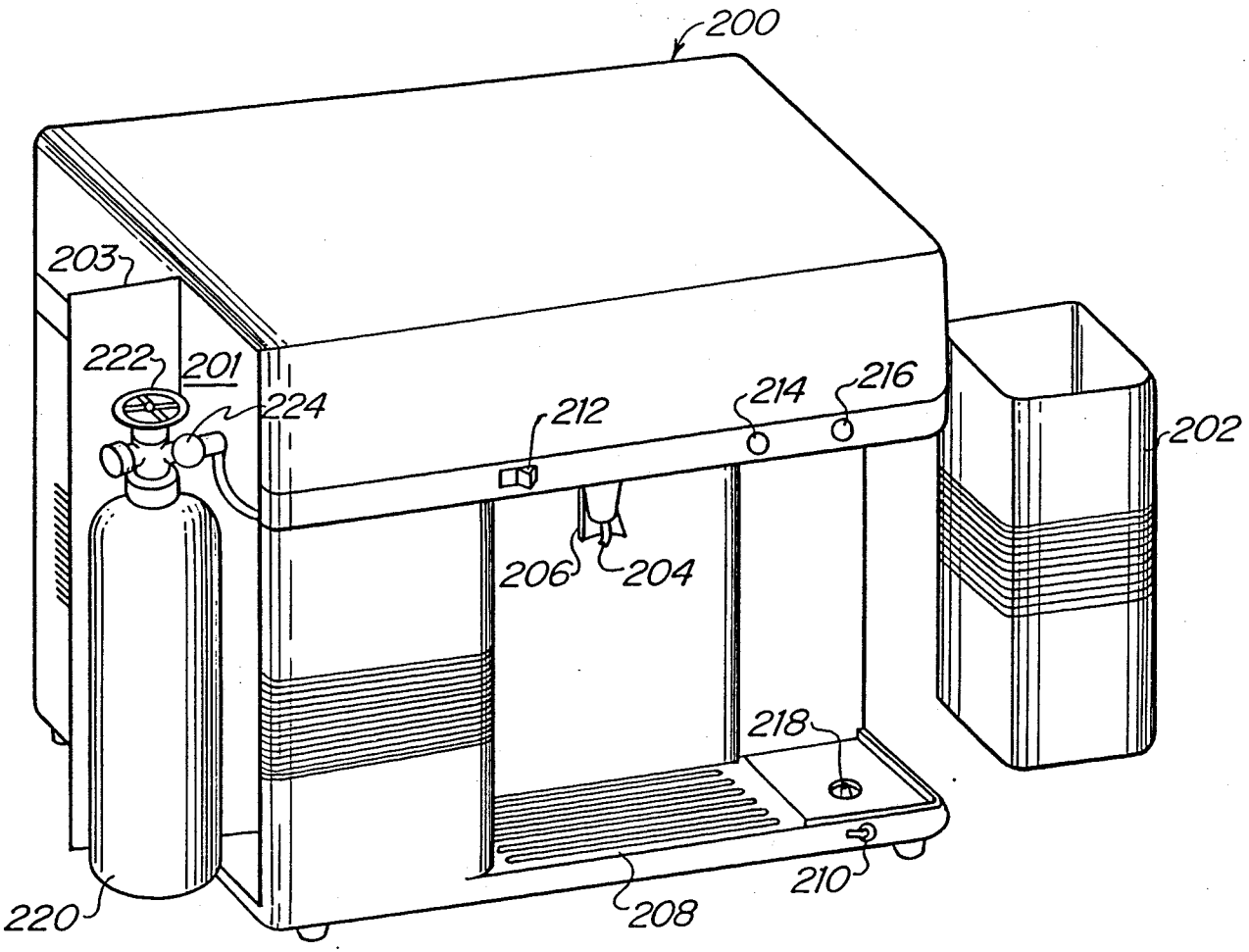
FIG. 10 is an exploded perspective view of the apparatus of FIG. 9.
Figure 15:
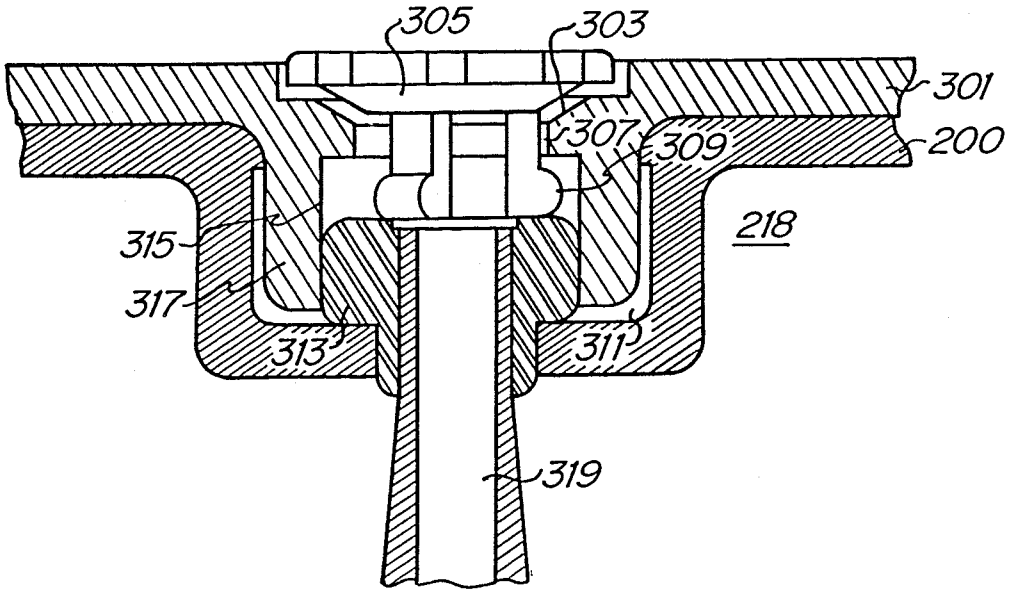
FIG. 15 is a sectional view of a self-sealing connector for the reservoir of FIG. 9.

Referring now to FIGS. 9 and 10, there are shown pictorial and exploded views, respectively, of a carbonator and drink dispenser according to the present invention as configured for home applications. The main cabinet 200 is configured to serve as a stand-alone console, for example, on a kitchen counter, and includes a removable reservoir 202 which has an open top for convenient, remote filling and which has a quick-connect, plug-in type water connector 218 associated therewith, as illustrated in FIG. 15, for easy removal for filling. In addition, the main cabinet 200 includes a side compartment 201 behind access door 203 in which a cylinder 220 of compressed carbon dioxide gas is housed. The cylinder 220 is fitted with an isolation or shut-off valve 222 and pressure regulator 224 for delivering carbon dioxide gas at controlled pressures to the carbonator, as later described herein. The cabinet 200 also houses refrigeration equipment and carbonator, later described, for delivering chilled, carbonated water via the manual dispensing valve 204, 206. Main cabinet 200 also has a valve toggle 210 so that the dispenser may be used either with municipal or reservoir input supplies.

Figure 11:
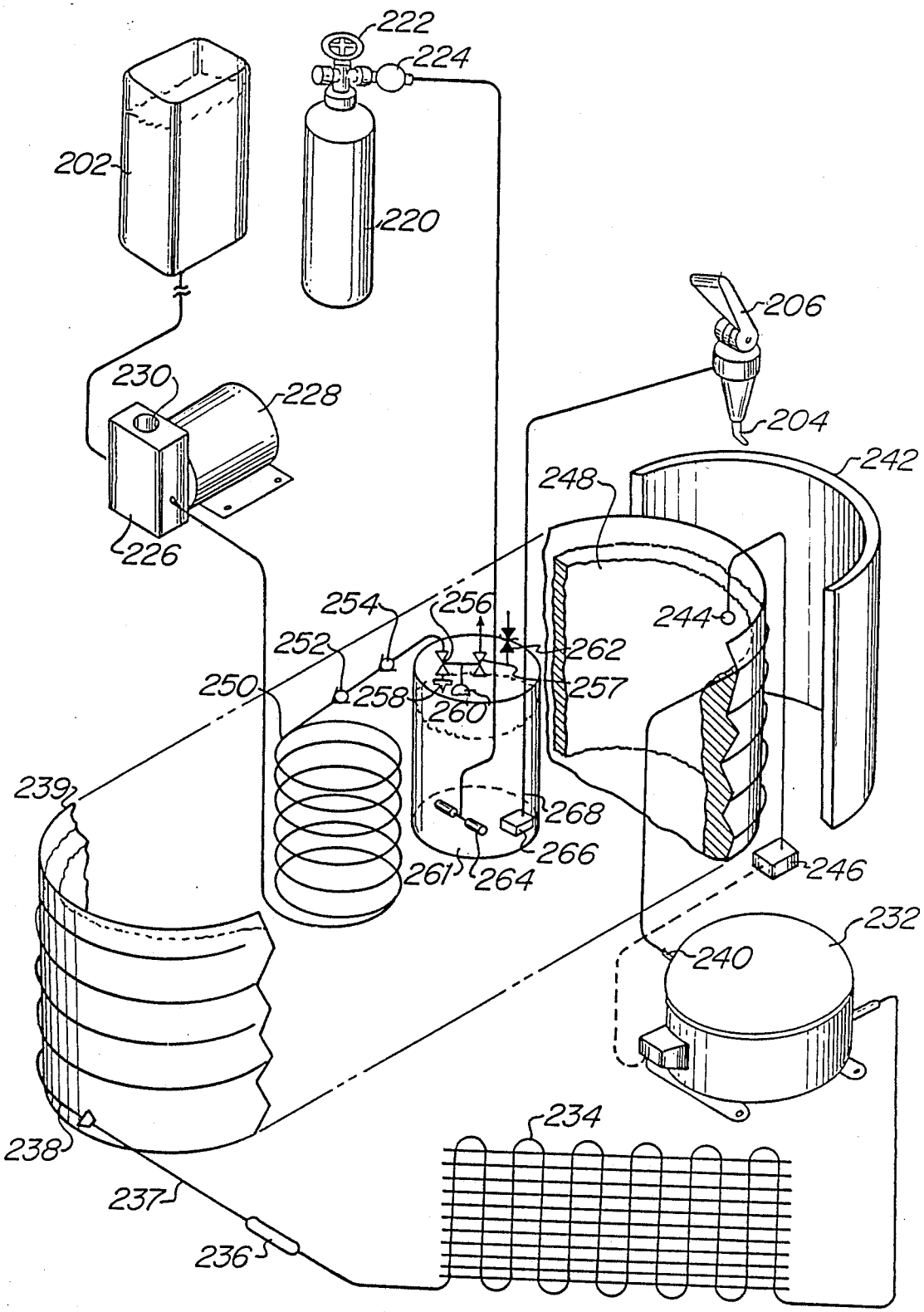
FIG. 11 is an exploded pictorial diagram of the internal comPonents of the apparatus of FIG. 9.

Referring now to the exploded schematic diagram of FIG. 11, there is shown a carbonator including pressure vessel 261 for confining a volume of liquid therein that is to be carbonated with carbon dioxide gas supplied thereto from the cylinder 220 via the diffusers 264 at the gas inlet to the vessel 261. Carbonated water is selectively withdrawn from the vessel 261 via the shielded outlet 266 and the manual dispensing valve 206. As carbonated water is dispensed, the liquid in the vessel 261 is replenished from the reservoir 202 by motor-driven pump 226, equipped in this embodiment with a pressure switch 230 and electric motor 228 which forces water under pressure through cooling coil 250 and check valves 252, 254 to the level-controlled inlet valve 256. Relief valve 262 communicating with the gas space at the top of the vessel 261 is useful for manually purging accumulated gases and for blowing off excessive internal gas pressure. Further, a vent valve 257 is supplied to vent the carbonator of excessive atmospheric gases. The vessel 261 and coil 250 are cooled via the refrigeration system including compressor 232 and capillary line 237 and filter-dryer 236 and evaporator plate or coil 238 that is disposed in close thermal coupling with the water coil 250 and vessel 261. For this purpose, there is shown a heat-conductive reservoir 239 for holding a body of water and forming ice on the interior surface thereof. Reservoir 239 has a surrounding insulating cover 242 to prevent thermal transmission from outside the reservoir to the interior thereof. The operating temperature of the carbonator vessel 261 is controlled by sensor 244 and control with 246 that turns on the compressor 232 when the operating temperature rises or the ice thickness shrinks to a limit, and turns off compressor 232 when the operating temperature is reduced to selected temperature or the ice thickness builds to a selected thickness. A cold water outlet and dispensing valve may be interposed between pump 226 and carbonator 261. In such a case it is desirable that the flow rate of the pump be sufficient to provide adequate cold water at the dispensing flow rate.

Figure 12:
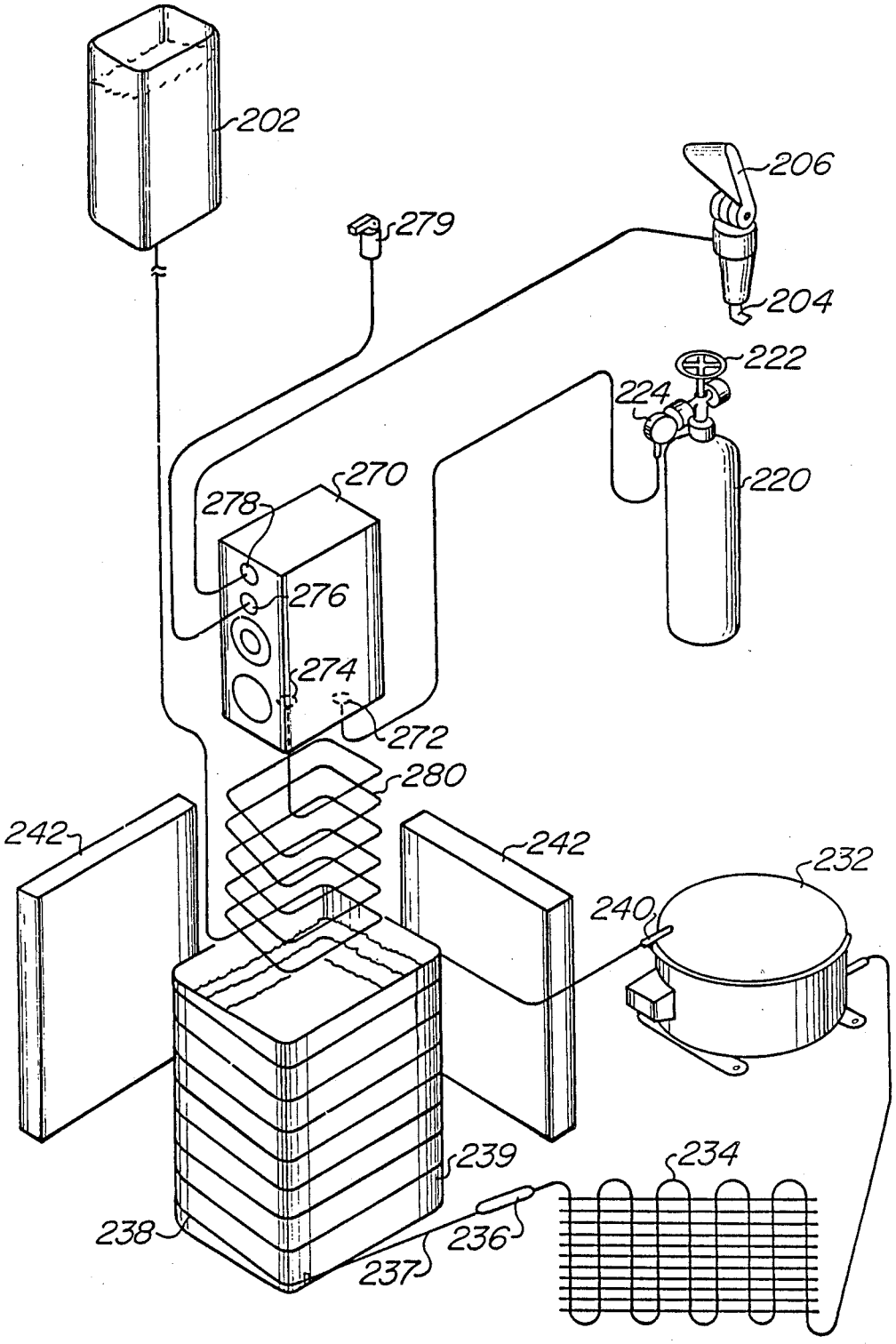
FIG. 12 is an exploded pictorial diagram of another embodiment of the apparatus of FIG. 10 employing an in-line carbonator with a gas-driven pump.

With reference to FIG. 12, there is shown an exploded schematic diagram of another embodiment of the present invention for operation with a gas-driven pump and, in-line carbonator unit 270 of the type described, for example in copending application Ser. No. 067,803, entitled "Gas-Driven Carbonator and Method", filed June 26, 1987, by Mark W. Hancock and Marvin M. May. In this embodiment, the carbonator pressure vessel 261 in FIG. 11 is replaced by a housing 270 which is connected to receive a supply of unpressurized water 202 via cooling coil 280, and a supply of carbon dioxide gas under pressure from cylinder 220. In a carbonator of this type, the water from reservoir 202 is pumped into a carbonating chamber in response to a gas-driven pump, and the exhaust gas from the pump is also supplied internally to the carbonating chamber to carbonate the water that was pumped into the chamber. The carbonator operates automatically in response to selective dispensing of carbonated water from the chamber via the manual dispensing valve 206. Of course, by porting the gas-driven pump before the in-line carbonator, cold water may also be provided by this system. A relief valve 279 is connected 278 to the carbonating chamber to vent excessive gas not passed with the outlet fluid. The in-line carbonator 270 and the inlet water coil 280 disposed about the carbonator are oriented within the evaporator plate or coil 238 for selective cooling by the refrigerator unit 232, 236, 237 in the manner as previously described. Insulating material 242 is disposed about the cooled components to inhibit thermal transfer between the environment and the cooled components.

Figure 13:
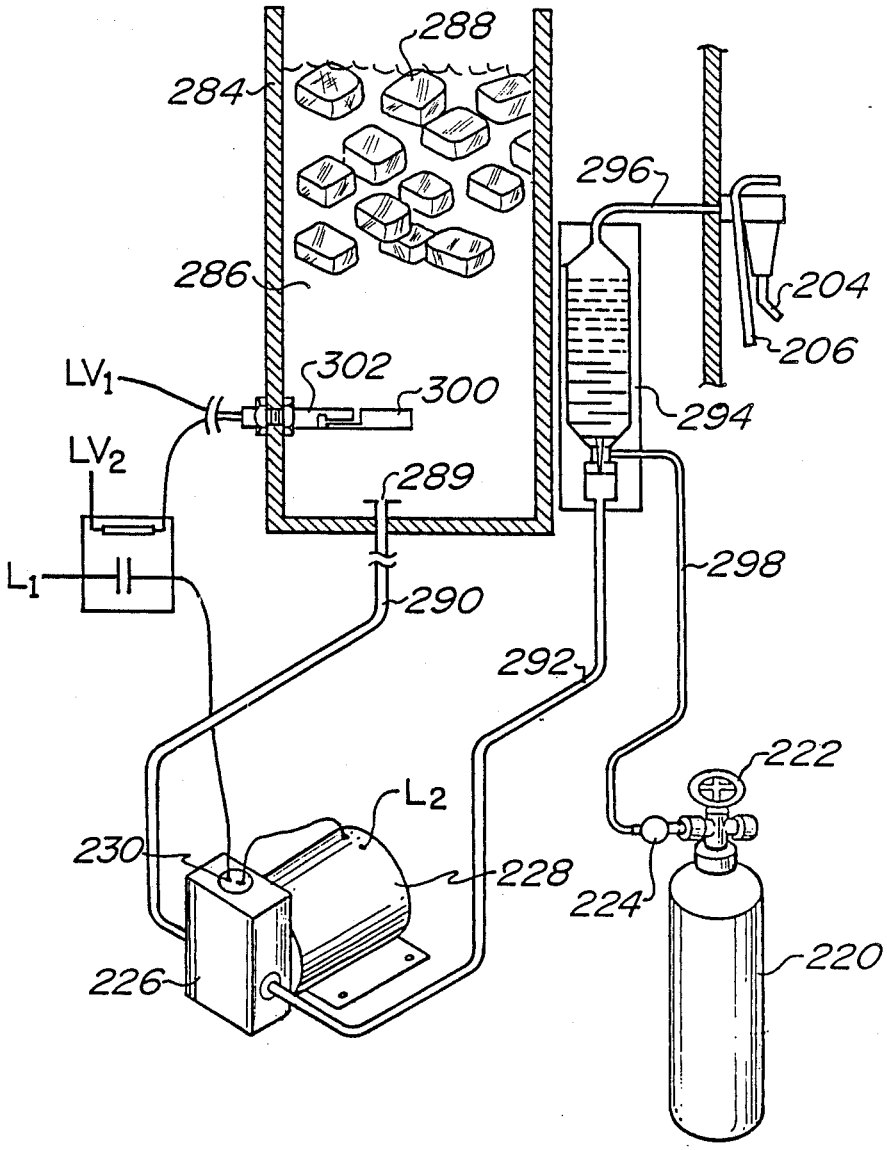
FIG. 13 is a sectional view of another embodiment of the present invention.

In another embodiment of the present invention, as illustrated in FIG. 13, the refrigeration unit of FIG. 11 and 12 may be replaced by a reservoir 284 if ice and water 286, 288 in which an in-line carbonator 294 is mounted in close isothermal relationship to the ice water (or may be submerged therein) for good isothermal equiliberation of operating temperatures. In this embodiment, the chilled water 286 is withdrawn from the reservoir via conduit 290 to the motor-driven pump 226, which forces the chilled water under pressure into the in-line carbonator 294. The carbonator 294 includes a series of fine screens and baffles interposed between its inlet for water and carbon-dioxide gas 293 and its outlet 296 for carbonated water. The manual dispensing valve 206 includes an angled outlet 204 which promoted swirling, mixing action within a cup or container into which the carbonated water is dispensed. The motor-driven pump 226, is controlled by float switch 302 and float 300, and by pressure switch 230 coupled to conduit 292 and located on pump 226. As carbonated water is dispensed through valve 206, the water pressure in conduit 292 drops and actuates the pump 226 to supply water under pressure to the in-line carbonator 294 as long as water is present (as sensed by float valve 302) in the reservoir 284.

Figure 14:
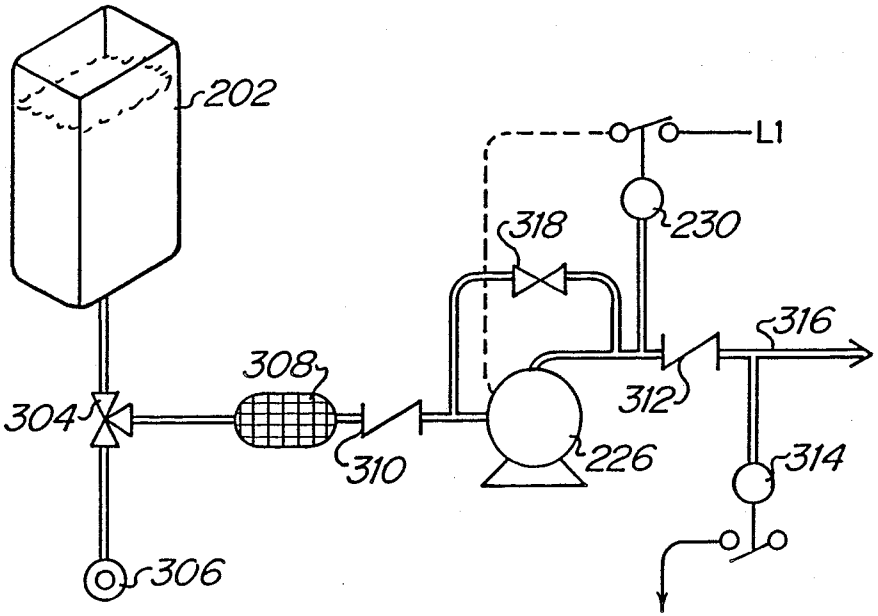
FIG. 14 is a schematic diagram of the pump connections in the apparatus of FIG. 11.

Referring to the schematic diagram of FIG. 14, there is shown a simplified schematic diagram of the pump connections for operation in one or other embodiments of the present invention. Instead of relying upon the limited supply of water available in reservoir 202, a selector valve 304 may be interconnected between reservoir 202 and a municipal source 306 of water under pressure for supplying water from either source through an inlet filter 308 and check valve 310 and 312 built into the inlet and outlet of pump 226, respectively. The pump is required in installations where municipal water pressure is too low and for operation from reservoir 202. The pump 226 is bypassed by pressure-relief valve 318 to prevent build-up of excessive outlet pressure, and the pump may be actuated in response to switch 230 which responds to the outlet water pressure. Similarly, operation of pump may be activated by a float switch or other electrical contact closure responsive to the liquid level (if a carbonator tank is used) or dispensing-rate responsive means (if an in-line carbonator is used).

Referring now to FIG. 15, there is shown a sectional view of a quick-disconnect coupling 218 for the reservoir 202 of FIG. 10. The lower boundary wall 301 of the reservoir includes a recessed valve seat 303 in which is located a slidable valve body 305 that is held captive within the aperture 307 by the protrusions 309 on the lower end of the valve body 305. The mating section of the connector is disposed on the reservoir-supporting section of cabinet 200 and includes a recessed receptacle 311 having a resilient sealing element 313 positioned to engage and seal against the inner walls 315 of the male section of the connector 317 formed on the reservoir 202. A central, hollow conduit 319 protrudes through the sealing element 313 to lift the valve body 305 from the valve seat 303 as the male section 317 inserts into receptacle 311. Thus, with reservoir in place, water may flow from the reservoir 202, through the valve seat 303 and through conduit 319 to the carbonator system previously described, and with reservoir 202 removed for filling, the valve body 305 and seat 303 are in lowered or sealed condition.

Referring now to FIG. 16, there is shown a perspective sectional view of a drink container suitable for post-mix soft drink preparation according to the present invention. The container 400 includes a measured quantity of drink-flavoring material 402 such as syrup or other beverage concentrate sealed within the lower section of the container 400 by a removable diaphragm 404. A pull-tab 406 is disposed along the inner surface of the container 400 (to facilitate nesting of such containers) and is attached to the diaphragm to facilitate manual removal thereof to unseal the flavoring material 402. With the container thus manually prepared and then positioned beneath the dispensing valve 206, carbonated water dispensed through the tube outlet tube 204 promotes mixing action of the carbonated water and flavoring material to produce a finished soft drink without need for a spoon or stirrer. Alternatively, an individual serving of a quantity of flavoring material 412 from a separate container 410, as illustrated in FIG. 17, may be prepared by removing a sealing lid 414 and depositing the contents in a drink container which is then positioned beneath the dispensing valve 206 which promotes the mixing action of the carbonated water dispensed into the pre-selected quantity of flavoring material within such drink container.

In commercial applications the container 400 or container 410 may be sold in vending machines located on or near the dispenser. For example, soda syrup storage container 90 illustrated in FIG. 3 may take the form of one or more vending machines capable of collecting money in exchange for an individual serving of flavoring concentrate.

In a preferred embodiment of the present invention, carbonated water is dispensed along the wall of the beverage container, which, in conjunction with a suitably angled outlet tube 204 causes a centrifugal stirring action. This method of dispensing has been determined to be effective in retaining a large percentage of the total dissolved carbon dioxide in the carbonator. For example, carbonated water swirled into a cup tester through a $\frac{1}{4}''$ ID tube bent at an angle of about 50 degrees toward horizontal from vertical has been found to produce slightly higher volume readings than when the same carbonated water was carefully dispensed (along the cup wall) into the cup tester through certain known post mix dispensing faucets equipped with diffusers. These known faucets dispensed carbonated water which tested even lower in carbonation when normal dispensing practices (into the center of the cup) were followed.

As the phenomenon is best understood, the aforecited tangential addition of liquid into the drink container reduces liquid velocity in general, and particularly the velocity component perpendicular to impact surfaces. Additionally, low velocities are understood to create a minimum of surface area exposure and mechanical agitation in the liquid being dispensed (and concomitant high retention of dissolved carbon dioxide). Such carbonation retention is often quite important to the palatability of the finished soft drink because of the dilution of carbon dioxide concentration by flavoring concentrates. The bent tube encourages the user to dispense the carbonated water tangentially along a wall of the drink container to create stirring and avoid high velocity impact which promotes decarbonation of the carbonated water.

In applications where it is desirable to precisely control the ratio of flavoring to carbonated water, a controlled or measured charge of carbonated water may be added to the aforecited measured quantity of drink-flavoring material. Since the carbonator pressure (in single faucet dispensing systems of the type described) is substantially constant or follows a reproducible curve during dispensing, the controlled charge of carbonated water may be delivered by timing means operatively coupled to or integrated with the dispensing valve. For example, dispensing valve 72 or 206 may be a timer-activated solenoid valve or a slow-to-close mechanical valve. In either case, a selected volume of carbonated water is delivered to the drink container each time the valve is activated. Alteranately, a prescribed volume of carbonated water may be dispensed by conventional filling means known in the art. Such means may include volume accumulators, probes which detect liquid level in the drink container as illustrated by line 401 in FIG. 16.

Figure 18:
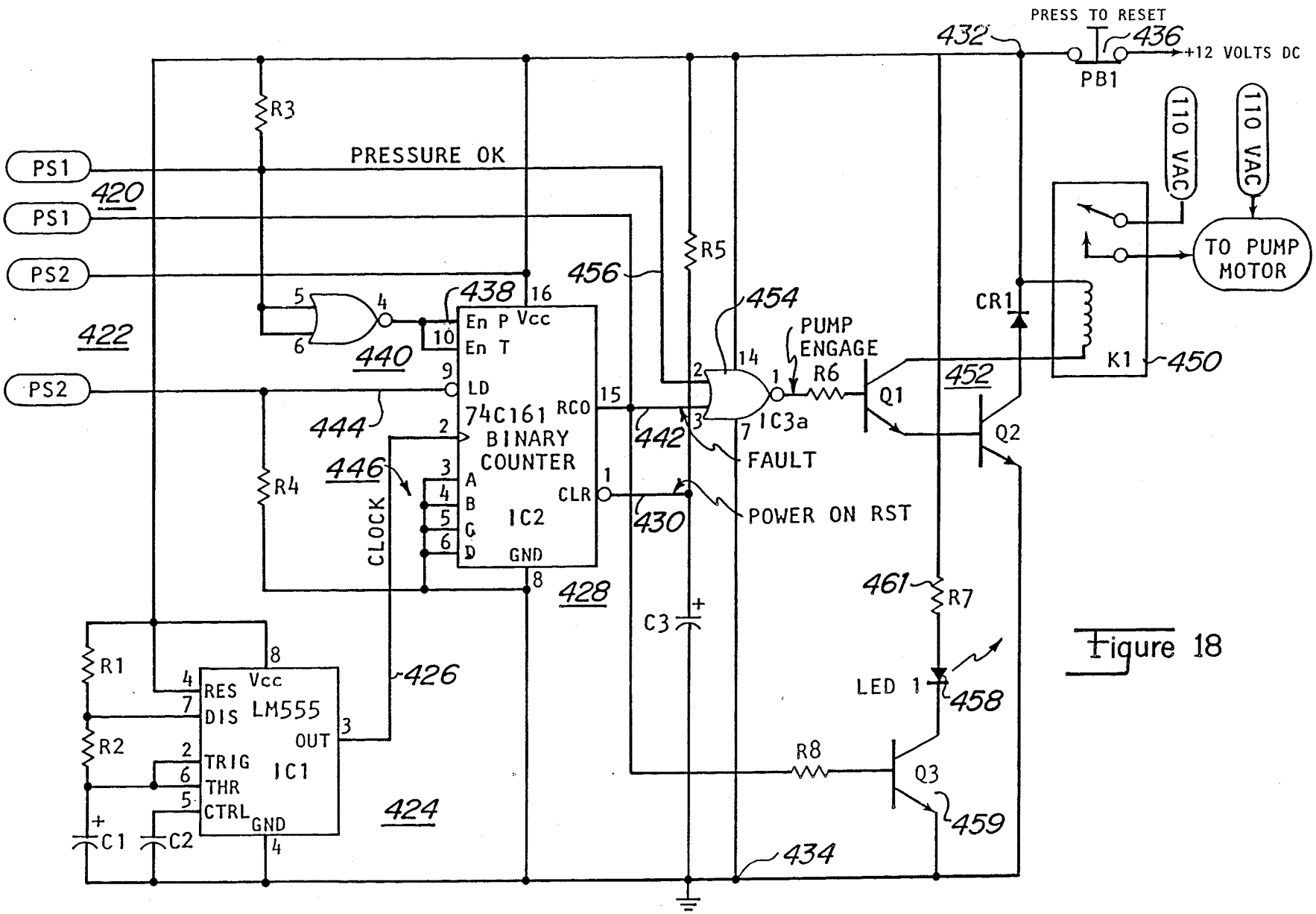
FIG. 18 is a schematic diagram of the control circuitry of the present invention.

Referring now to FIG. 18, there is shown a schematic diagram of the circuitry for controlling the motor-driven pump according to the present invention and is suited for use in carbonation systems capable of operating from both pressurized and reservoir sources. The circuit is connected 420 to a switch in the supply line at the motor-driven pump, and is connected 422 to a switch (for example, pressure switch 314 of FIG. 14) in the pressurized output of the pump. The switch connected at terminal 420 is normally open under normal conditions of water available to supply to the pump, and the switch connected at terminal 422 is normally open and closes when pressure exceeds a selected limit at the output of the pump. The circuit includes a series combination of resistors $R_1$ and $R_2$ and capacitor $C_1$ connected to an integrated circuit IC 1 to form an astable multivibrator 424 capable of producing output pulses 426 at a rate of about one pulse per second. These output pulses are supplied as clock pulses to an integrated circuit counter 428. This counter has a clear input which is connected to the common junction of the resistor $R_5$ and capacitor $C_3$ that are serially connected across the power lines 432, 434. Upon power applied initially (or upon pressing reset switch 436 in power line 432), the signal on clear input 430 approaches logical '1' that enables the counter to operate in normal mode from its initial state. Thus, after start-up or reset with adequate water available to prevent the switch connected to terminals 420 from closing, the counter 428 is disabled from counting by the enable inputs 438 held at logical '0'. by the input to NOR-gate inventer circuit 440 being pulled toward logical '1' by resistor $R_3$. The fault output 442 is therefore at logical '0', or disabled.

Now, if the supply of water drops, the switch connected to terminals 420 closes, the '0' logic signal value from the fault output 442 is applied through such switch to the inverter circuit 440 which thus applies an enabling logical '1' signal to the enable input 438. Counter 428 thus counts from zero state toward fifteen. If flow upstream from the pump is not obstructed and the switch connected to terminal 422 remains open, then resistor $R_4$ connected to the load input 444 holds the input 444 at logical '0'. The counter continuously loads the logical values (i.e. '0' logical inputs) at the preset inputs A, B, C, D 446 under this condition and therefore continually resets back to zero counting state.

If flow upstream of the pump is obstructed, causing the switch connected to remain 422 to close, the load input 444 is connected through such switch to the supply line 432 and is thereby pulled up to logical '1' value. The counter 428 is thus enabled to count up from the last preset value (namely, zero count state). If the flow obstruction upstream from the pump does not clear, then a fault condition appears on line 442 as a logical '1' value in response to the counter counting up to 'fifteen' (in about 15 seconds). This condition will appear on line 442 independently of whether the switch connected to terminals 420 is closed or not. Any changes in such switch are therefore ignored, and the enable inputs 438 therefore remain at logical '0' value. The control circuitry thus remains in this fault condition until the flow obstruction improves and the switch connected to terminals 422 opens.

The pump motor is controlled by the relay 450 from line voltage (or other suitable supply lines) under control of the Darlington-coupled transistor amplifier 452. This amplifier 452 receives the output of NOR Gate 454 so that the pump may be energized only when the switch connected at terminals 420 indicates adequate water available to supply to the pump, and the switch connected upstream from the pump indicates no flow obstruction.

Alternatively stated, if either the fault signal on line 442 or the signal on line 456 is logical '1' value, the pump is disabled. In addition, the light-emitting diode 458 that is connected in series with transistor 459 and resistor 461 is activated by the condition (logical '1') on line 442 to provide visual indication of the associated fault condition. Of course, input signals from conventional flow, vacuum, or current-sensing switches appropriately disposed in the system as previously described may also be used in the illustrated control circuit to accomplish the same function as described above.

We claim:

1. Carbonator apparatus for operation on a bottled supply of water, the apparatus comprising:

a liquid reservoir having a top opening for receiving a bottled supply of water therein for automatically refilling said reservoir from the bottled supply of water;

means for cooling water in said reservoir to form a quantity of ice therein including means disposed to sense the thickness of said ice to maintain the quantity of ice within selected limits;

carbonator means disposed in thermal relationship to the water in said reservoir to be cooled thereby;

pumping means for pumping water from said reservoir into said carbonator means;

dispensing means for selectively withdrawing carbonated water from the carbonator means;

first means for sensing when the liquid level therein drops below a predetermined level;

second means for sensing when water in the reservoir is depleted below a selected level; and control means responsive to first and second means to enable said pumping means when said liquid level in said carbonator means drops below said predetermined level, and to prevent said pumping means from pumping in response to water in the reservoir being depleted below said selected level.

2. The method of carbonating water from a bottled supply of water, the method comprising the steps of:

accumulating a re serve of water selectively supplied from the bottled supply;

cooling the reserve of water to form a quantity of ice therein, sensing the thickness of said ice to maintain the quantity of ice within a selected range;

combining a confined volume of cooled water from said reserve with a quantity of carbonating gas under pressure;

withdrawing carbonated water from the confined volume;

replenishing the confined volume of water and quantity of carbonating gas in response to the withdrawal of carbonated fluid; and inhibiting the replenishing of the confined volume of water in response to substantial depletion of accumulated reserve of water.

3. Carbonator apparatus for operation on a supply of water, the apparatus comprising:

a water reservoir having an opening for receiving a supply of water for automatically refilling said water reservoir from the supply;

means for cooling water in said water reservoir to form a quantity of ice therein;

sensing means coupled to said means for cooling and disposed to sense the quantity of said ice for maintaining the quantity of ice within a selected range;

a carbonator disposed in thermal relationship to water in the reservoir to be cooled thereby;

means for pumping water from said reservoir into said carbonator;

means for sensing when water in reservoir is less than a selected amount; and control means responsive to said means for sensing to prevent said means for pumping from operating in response to water in said reservoir decreasing to less than said selected amount.

4. The method of carbonating a liquid comprising the steps of:

cooling a reserve of uncarbonated liquid to form a quantity of ice;

sensing the quantity of said ice to maintain the quantity of ice within a selected range;

carbonating cooled uncarbonated liquid from the reserve;

selectively withdrawing carbonated liquid following carbonation;

automatically replenishing the reserve of uncarbonated liquid from another source; and inhibiting the carbonating of uncarbonated liquid in response to substantial depletion of uncarbonated liquid from said reserve.

5. The method according to claim 4 wherein the step of automatically replenishing includes controlling the replenishing of the reserve of uncarbonated liquid to promote rapid cooling of the replenished liquid.

6. Apparatus for dispensing a soft drink within a container, the apparatus comprising:

a liquid reservoir including means for automatic refilling thereof;

means for cooling the liquid in said reservoir to form a quantity of ice therein;

sensing means coupled to said means for cooling and disposed to sense ice in said reservoir for maintaining the quantity of ice within a selected range;

a carbonator operatively connected to said first reservoir;

means for pumping liquid from said first reservoir into said carbonator; and means for dispensing carbonated liquid from said carbonator in swirling and mixing relationship with a preselected quantity of flavoring syrup disposed within a container positioned to receive the dispensed carbonated liquid to form a carbonated soft drink therefrom in the container.

7. A method of making a carbonated soft drink from flavoring syrup disposed within a container, the method comprising the steps of:

cooling a reserve of water;

carbonating cooled water from the reserve;

replenishing water withdrawn from the reserve;

selectively withdrawing carbonated water following carbonation thereof; and dispensing the carbonated water in swirling and mixing relationship with the preselected quantity of flavoring syrup disposed within a container to form the carbonated soft drink in the container from the dispensing of the carbonated water.

8. A carbonator system comprising:

a carbonator tank operatively connected to a pressurized source of carbonating gas and to a refillable liquid reservoir for producing carbonated liquid in said carbonator tank;

means for pumping liquid from said reservoir into said carbonator tank;

liquid level sensor means disposed in said carbonator tank for sensing when the liquid level therein drops below a predetermined level;

manual activation means connected to selectively dispense carbonated liquid from said carbonator tank and operatively coupled to said means for pumping for supplying electrical power thereto;

timing means operatively coupled to said means for pumping; and control means operatively connected to said manual activation means and to said liquid level sensor means to enable said means for pumping in response to both manual activation means selectively dispensing carbonated liquid from said carbonator tank and liquid level sensor means sensing when the liquid level in said carbonator tank drops below a predetermined level and to disable said means for pumping after a predetermined period of time.

9. A carbonator system comprising;

a carbonator tank operatively connected to a pressurized source of carbonating gas and to a refillable liquid reservoir for producing carbonated liquid in said carbonating tank;

means for pumping liquid from said reservoir into said carbonator tank;

liquid level sensor means disposed in said carbonator tank for sensing when the liquid level therein drops below a predetermined level;

manual activation means connected to selectively dispense carbonated liquid from said carbonating tank and operatively coupled to said means for pumping for supplying electrical power thereto;

liquid sensor means connected with said means for pumping and with said reservoir for detecting when there is an absence of liquid to be carbonated supplied to the means for pumping from said reservoir; and control means operatively connected to said manual activation means and to said liquid level sensor means to enable said means for pumping in response to both manual activation means selectively dispensing carbonated liquid from said carbonator tank and liquid level sensor means detecting when the liquid level in said carbonator tank drops below a predetermined level and to disable said means for pumping when said liquid sensor means detects the substantial depletion of said liquid to be carbonated.

10. Carbonator apparatus for operation on a reservoir of water, the apparatus comprising:

an in-line carbonator including a fluid conduit for directing the flow of fluid therethrough from a liquid inlet to a remote fluid outlet, and having a gas inlet coupled thereto at a location along the conduit intermediate the inlet and outlet;

means for cooling water in a reservoir for forming and maintaining a quantity of ice therein;

pump means coupled to the reservoir and to the in-line carbonator for supplying water under pressure to the liquid inlet of the in-line carbonator means from the reservoir; and supply means of carbonating gas under pressure coupled to the gas inlet of the in-line carbonator to supply gas to said fluid conduit for mixing with liquid therein substantially only during the pumping means supplying water under pressure thereto.

11. Carbonator apparatus as in claim 10 wherein:

said pump means and said in-line carbonator are disposed to operate in an environment of reduced ambient temperature in thermal relationship with water in the reservoir to be cooled thereby.

12. Carbonator apparatus as in claim 10 wherein:

said pump mans includes gas-driven displacement means having a gas outlet and a gas inlet coupled to receive a supply of gas under pressure and being disposed with said fluid conduit in a common housing; and said housing is disposed within an environment of reduced operating temperature in thermal relationship with water in the reservoir to be cooled thereby.

13. Carbonator apparatus as in claim 12 wherein:

said housing is disposed within water in the reservoir; and said means for cooling water cools the water within the reservoir to form and maintain a quantity of ice within the reservoir.

14. Carbonator apparatus as in claim 10 comprising:

manual valve means coupled to said fluid outlet for selectively releasing fluid from said fluid outlet and for activating said pumping means in response to the release of fluid from said fluid outlet.

15. Dispensing apparatus comprising:

a reservoir disposed to be supplied with water from a source of water;

means coupled to said reservoir for cooling water therein to form a quantity of ice therein;

sensing means coupled to said means for cooling and disposed for maintaining the quantity of ice within a selected range; and outlet means connected to said reservoir for selectively dispensing cool water directly therefrom.

16. A carbonator system for operation from a replenishable reservoir on a pressurized supply of carbonating gas, comprising:

a carbonator tank operatively connected to a pressurized source of carbonating gas and to a replenishable liquid reservoir for producing carbonated liquid in said crbonator tank;

means for pumping liquid from said reservoir into said carbonator tank;

liquid level sensor means disposed in said carbonator tank for sensing when the liquid level therein drops below a predetermined level;

pressure sensor means connected to the pressurized source of carbonating gas for sensing reduction of gas pressure below a selected value;

manual activation means connected to selectively dispense carbonated liquid from said carbonating tank and operatively coupled to said means for pumping for controlling the supply of electrical power thereto; and control means operatively connected to said manual activation means and to said liquid level sensor means and to said pressure sensor means to enable said means for pumping in response to both manual activation means selectively dispensing carbonated liquid from said carbonator tank and liquid level sensor means detecting when the liquid level in said carbonator tank drops below a predetermined level and to disable said means for pumping when said pressure sensor means detects a reduction of pressure below a selected value.

* * * * *